US008036410B2

(12) United States Patent
Koren et al.

(10) Patent No.: US 8,036,410 B2
(45) Date of Patent: Oct. 11, 2011

(54) OFFSET BAFFLES FOR ACOUSTIC SIGNAL ARRIVAL SYNCHRONIZATION

(75) Inventors: Daniel M. Koren, Burnsville, MN (US); Nicholas J. Sulzer, Burnsville, MN (US); Steven J. Jakowski, Farmington, MN (US)

(73) Assignee: Robert Bosch GmbH, Stuttgart (DE)

( * ) Notice: Subject to any disclaimer, the term of this patent is extended or adjusted under 35 U.S.C. 154(b) by 884 days.

(21) Appl. No.: 12/045,531

(22) Filed: Mar. 10, 2008

(65) Prior Publication Data

US 2009/0226019 A1 Sep. 10, 2009

(51) Int. Cl.
*H04R 25/00* (2006.01)

(52) U.S. Cl. ..... 381/345; 381/349; 381/354

(58) Field of Classification Search ..... 381/337, 381/345–346, 348–349, 352–354
See application file for complete search history.

(56) References Cited

U.S. PATENT DOCUMENTS

| | | | |
|---|---|---|---|
| 3,582,553 | A | 6/1971 | Bose |
| 3,645,355 | A | 2/1972 | Long |
| 3,796,839 | A | 3/1974 | Torn |
| 3,824,343 | A | 7/1974 | Dahlquist |
| 3,927,261 | A | 12/1975 | Dahlquist |
| 3,983,333 | A | 9/1976 | Allison |
| 4,811,406 | A | 3/1989 | Kawachi |
| 5,533,132 | A | 7/1996 | Button |
| 5,548,657 | A | 8/1996 | Fincham |
| 6,343,134 | B1 | 1/2002 | Czerwinski |
| 6,549,637 | B1 | 4/2003 | Risch |
| 6,731,765 | B1 | 5/2004 | Sotome |
| 2006/0256997 | A1 | 11/2006 | Sagren |

FOREIGN PATENT DOCUMENTS

| | | |
|---|---|---|
| FR | 2378418 | 8/1978 |
| GB | 1516935 | 7/1978 |

OTHER PUBLICATIONS

Crossover Offset Study, "Speaker Measurement Techniques for Crossover Design", http://www.purspeakers.com/offsets.html, printed from website on Feb. 11, 2008, 2 pages.

(Continued)

*Primary Examiner* — Suhan Ni

(57) ABSTRACT

Offset baffles are provided in a speaker for acoustic signal arrival synchronization. The speaker includes an enclosure. The enclosure includes a first side positioned at an angle with respect to a horizontal axis or plane. The first side includes an upper portion and a lower portion. The upper portion and the lower portion are offset from one another by a first offset in a first direction and a second offset in a second direction. The first offset in the first direction and the second offset in the second direction define a vent extending across a width of the first side. The vent is positioned above a low-frequency transducer and below a high-frequency transducer. The low-frequency transducer is mounted to the lower portion and generates a first acoustic signal within a first frequency range. The high-frequency transducer is mounted to the upper portion and generates a second acoustic signal within a second frequency range. The low-frequency transducer and the high-frequency transducer are displaced by the first offset in the first direction and the second offset in the second direction to adjust a low-frequency transducer acoustic origin position and a high-frequency transducer acoustic origin position. The upper portion and the lower portion configured such that a first acoustic signal arrival time and a second acoustic signal arrival time are synchronized in a listening area

21 Claims, 7 Drawing Sheets

OTHER PUBLICATIONS

Dipole Offset, "Tech Design . . . Correcting acoustic center offsets in dipole speakers . . . " http://www.musicanddesign.com/Dipole-offset.html, printed from website on Jan. 2008, 11 pages.
Chawla, Sumit, Secrets of Home Theater and High Fidelity, http://www.hometheaterhifi.com/volume_13_2/revel-f52-c52-s30-b15 . . . , dated Jun. 2006, 4 pages.
Bosch, LBC 3800/10 Prosound Cabinet Loudspeaker, 100 W Product Information, www.boschsecurity.com, dated Dec. 12, 2005, 4 pages.
ZZOUNDS.COM, Stage PA Floor Monitors from zZounds.com, http://www.zzounds.com/cat—2739, printed from website on Feb. 11, 2008, 5 pages.
Yamaha, Owner's Manual for Speaker System and Subwoofer, http://www2.yamaha.co.jp/manual/english/, dated 2004, 8 pages.
Yamaha, A Series Speakers, www.yamahaproaudio.com, 2 pages.
Speaker Workshop Tutorial, Crossover Simulation in Speaker Workshop—Tutorial, http://www.angelfire.com/electronic/loudspeaker/projects/speakerworkshop.html, printed from website on Feb. 11, 2008, 6 pages.
ZZOUNDS.COM, Stage PA Monitors—"monitor" at zZounds.com, http://www.zzounds.com/prodsearch?form=search&q=monitor&p=2&..., printed from website on Feb. 13, 2008, 3 pages.
ZZOUNDS.COM, Yamaha SM15V Club V from zZounds.com!, http://www.zzounds.com/item—YAMSM15..., printed from website on Feb. 13, 2008, 2 pages.
Google Patent Search, speaker baffle offset acoustic center, http://www.google.com/patents?q=speaker+baffle+offset+acoustic+ce..., dated Feb. 13, 2008, 3 pages.
Google Patent Search, low frequency baffle acoustic center, http://www.google.com/patents?q=low+frequency+baffle+acoustic+centers&btnG=Search..., dated Feb. 11, 2008, 2 pages.
Musician's Friend, Yamaha Al2M 12" 2-Way Floor Monitor, http://www.musiciansfriend.com/product/Yamaha-A12M-12Inch-2Way-Floor-Monitor? sk..., printed from website on Feb. 11, 2008, 2 pages.
EP09003363.0 European Search Report, 6 pages, dated May 14, 2009.

OFFSET BAFFLES FOR ACOUSTIC SIGNAL ARRIVAL SYNCHRONIZATION

BACKGROUND

The present invention relates to audio speakers. A speaker is an electromechanical device that produces acoustic signals across a frequency range depending, at least in part, on one or more types of drivers used in the speaker. The term speaker can refer to a device with a single driver, multiple drivers, or a device that includes one or more drivers, an enclosure, and additional components such as a crossover circuit. It is often desirable for a speaker to produce an acoustic output across the band of frequencies that are audible to a human. Sometimes, a "flat" output from about 20 Hz to about 20 kHz is viewed as an ideal characteristic for a speaker to possess. However, in practice, the acoustic output of a speaker is often attenuated at one or more frequencies or across one or more bands of frequencies.

SUMMARY

While various ideal performance characteristics for speakers are known and have been postulated, achieving them is practice is not always possible, particularly in light of cost and other constraints.

In one embodiment, the invention provides a speaker with an improved frequency response that is achieved at little or no increased expense. The speaker includes an enclosure. The enclosure includes a first side positioned at an angle with respect to a horizontal axis or plane. The first side includes an upper portion and a lower portion. The upper portion and the lower portion are offset from one another by a first offset in a first direction and a second offset in a second direction. The first offset in the first direction and the second offset in the second direction defining a vent extending across a width of the first side. The vent is positioned above a low-frequency transducer and below a high-frequency transducer. The low-frequency transducer is mounted to the lower portion and is configured to generate a first acoustic signal within a first frequency range. The high-frequency transducer is mounted to the upper portion and is configured to generate a second acoustic signal within a second frequency range. The low-frequency transducer and the high-frequency transducer are displaced by the first offset in the first direction and the second offset in the second direction to adjust a low-frequency transducer acoustic origin position and a high-frequency transducer acoustic origin position. The upper portion and the lower portion are configured such that a first acoustic signal arrival time and a second acoustic signal arrival time are synchronized in a listening area.

In another embodiment, the invention provides a floor monitor speaker that includes an enclosure. The enclosure includes a lower baffle at a first angle with respect to a horizontal axis and an upper baffle positioned at a second angle with respect to the horizontal axis. The lower baffle and the upper baffle are offset from one another by a first offset in a first direction and a second offset in a second direction. The first offset and the second offset define a vent extending across a width of the first side. The vent is positioned above a woofer and below a horn. The woofer is mounted to the lower baffle and is configured to generate a first acoustic signal within a first frequency range. The horn is mounted to the upper baffle and is configured to generate a second acoustic signal within a second frequency range. The woofer and the horn are displaced by the first offset in the first direction and the second offset in the second direction to adjust a woofer acoustic origin position and a horn acoustic origin position. The woofer acoustic origin position and the horn acoustic origin position are adjusted such that a first acoustic signal arrival time and a second acoustic signal arrival time are synchronized in a listening area.

In another embodiment, the invention provides a method of synchronizing at least two acoustic signals at respective acoustic origins. The method includes positioning a lower baffle at a first angle with respect to a horizontal axis, positioning an upper baffle at a second angle with respect to the horizontal axis, mounting a woofer to the lower baffle, and mounting a horn to the upper baffle. The method includes adjusting a woofer acoustic origin position and a horn acoustic origin position by displacing the lower baffle and the upper baffle by a first offset in a first direction and a second offset in a second direction. The method also includes positioning the upper baffle and the lower baffle such that there is a vent between the two. The method further includes generating, at the woofer, a first acoustic signal within a first frequency range, generating, at the horn, a second acoustic signal at a second frequency range, and synchronizing a first acoustic signal arrival time and a second acoustic signal arrival time in a listening area.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
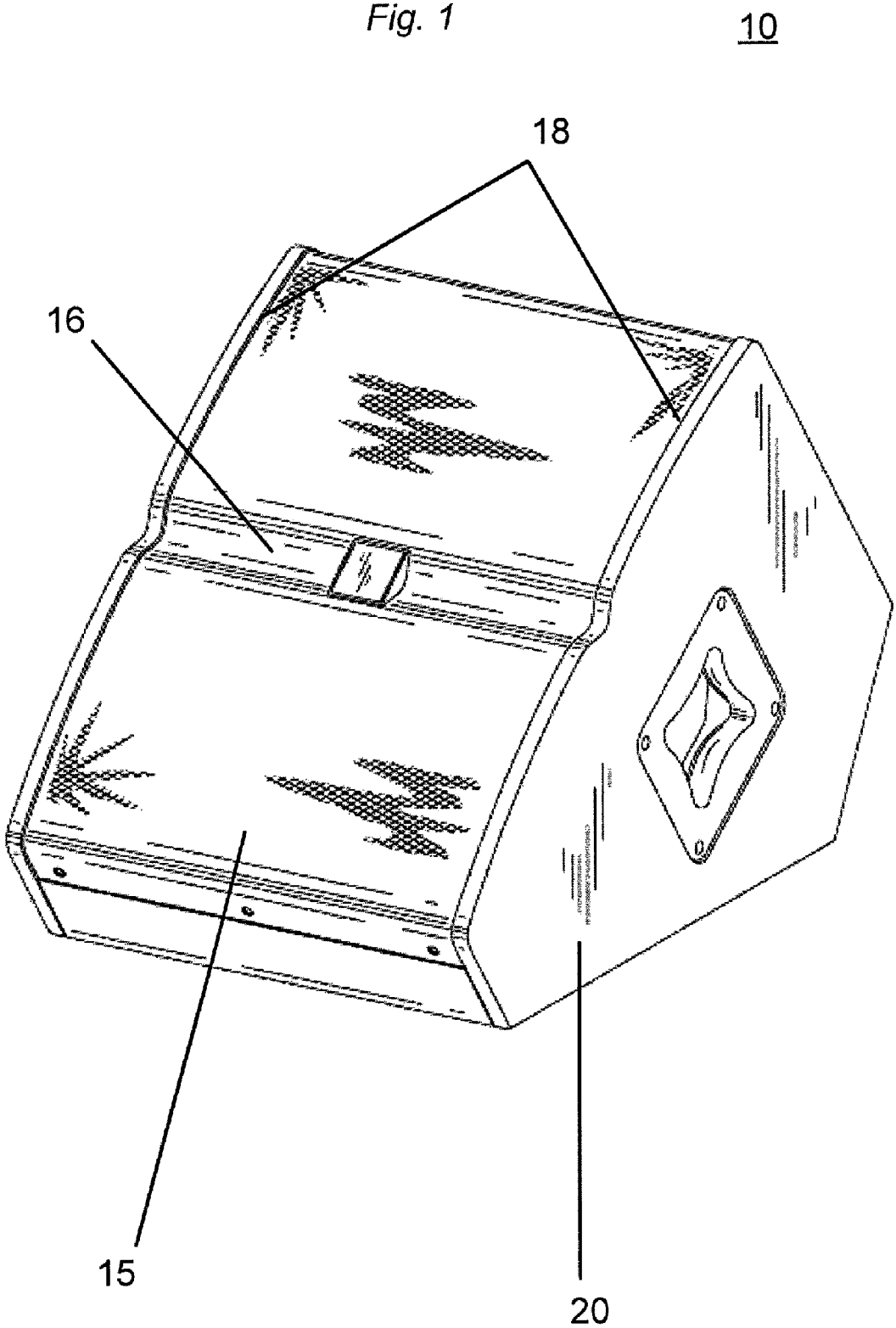
FIG. 1 illustrates a speaker according to an embodiment of the invention.

FIG. 1 illustrates a speaker 10 that includes a speaker enclosure 20. Depending on a speaker type, the speaker 10 includes one or more drivers (or transducers) capable of reproducing one or more acoustic signals within certain frequency ranges, frequency bands, or bandwidths. As is discussed below, in the embodiment shown, the speaker 10 includes a low-frequency driver (or woofer) and a high-frequency driver (a horn or horn tweeter). In other embodiments, additional or alternative drivers could be used. The speaker 10 of FIG. 1 is a floor monitor speaker which is designed to project or direct sound upwards toward a performer or musician located, for example, on stage in, for example, a standing position. In other embodiments, the speaker 10 could be designed to project or direct sound to an audience.

In some embodiments of the invention, the enclosure 20 includes a speaker grille 15. The speaker grille 15 is, for example, a hard or soft grille mounted over the speaker driver (i.e. woofer, tweeter, etc.) or other components of the speaker 10. The speaker grille 15 can be covered with a fabric that allows sound to pass while protecting the speaker drivers and other components of the speaker 10 from dust, dirt, and physical damage. In one embodiment, the speaker grille 15 is made of metal (or a similar, relatively stiff and hard material) and includes a rib 16. The rib 16 provides additional strength and stiffness to the speaker grille 15. The rib 16 also reduces flexing of, and vibration in the speaker grille 15. In some embodiments, the rib 16 eliminates the need for a central brace which is, in many instances, required to provide necessary support and strength to a speaker grille. Without the need for additional bracing, the depth of the enclosure 20 is reduced and manufacturing time is decreased. The rib 16 can take many forms beside the also aesthetically pleasing one shown in FIG. 1. In addition to the arcuately-shaped or sinusoidally shaped form of the rib 16 as shown in FIG. 1, the rib 16 may also have a triangular shape, a rectangular shape, or a trapezoidal shape, for example. Instead of the one rib 16 shown, there can also be more than one rib 16 arranged across the speaker grill 15. In case of more than one rib 16 the ribs 16 can be arranged in a parallel manner to each other or at an angle to each other or having the shape of letters.

The speaker 10 also includes a vein line 18. The vein line 18 runs around the enclosure 20 from front to back, as opposed to being inset on a side panel. In some embodiments, the speaker enclosure 20 does not include the speaker grille 15.

Before continuing to describe the speaker 10, note that the term "signal," as used herein, describes a signal that includes a single frequency or a signal that includes a plurality of frequencies. For example, for ease of writing, transducers are sometimes described herein as producing "an acoustic signal." However, in actuality, the transducer might produce multiple acoustic signals; for example, all or a portion of the acoustic frequencies necessary to reproduce music. Thus, references to "a signal" or similar terms should not, necessarily, be interpreted as being limited to a signal composed of just one frequency, for example, a tone at 400 Hz. Instead, the term signal should be recognized as potentially including components at multiple frequencies. So for example, the acoustic signal or output of a woofer might include frequencies between about 50 Hz and about 1.8 kHz.

Figure 2:
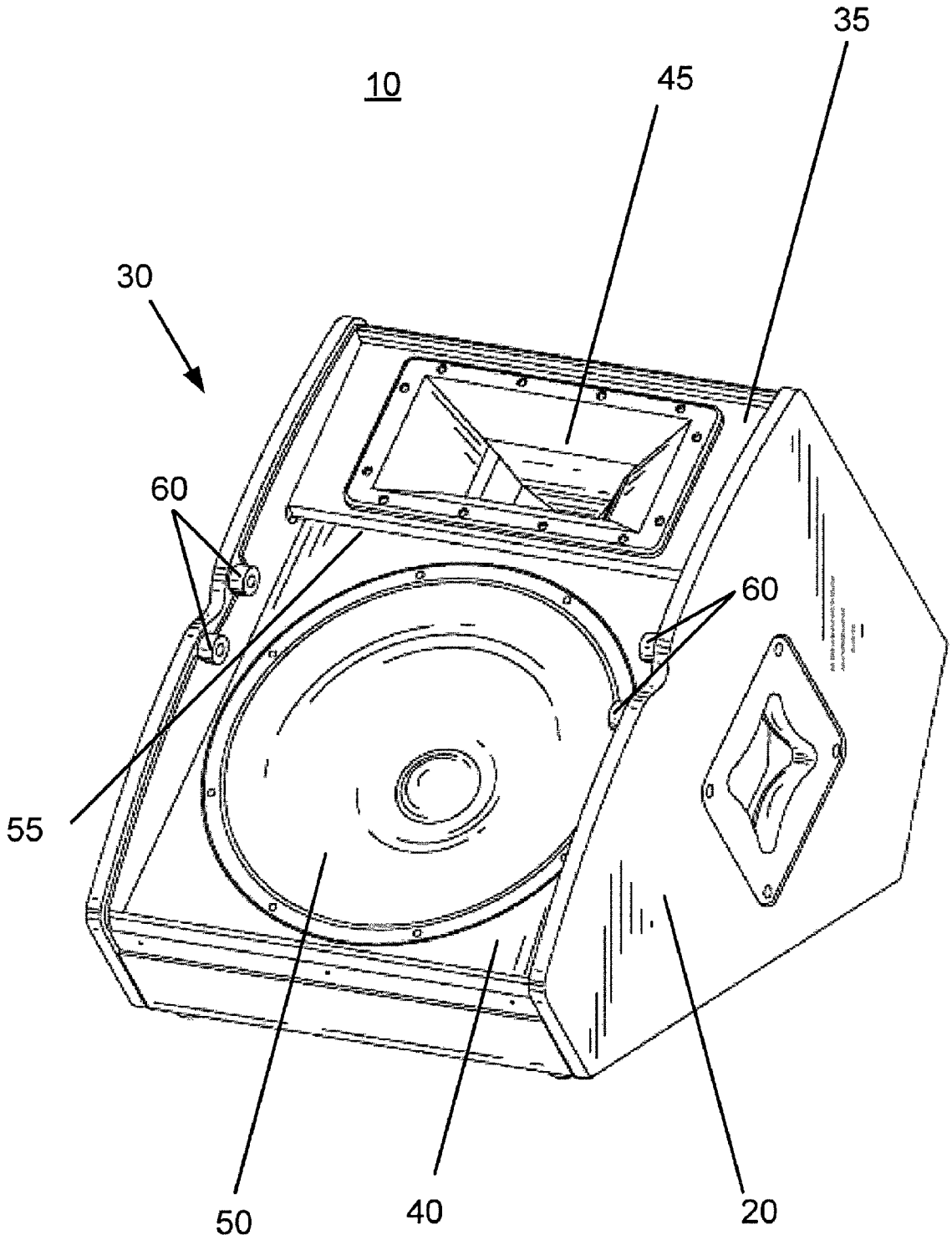
FIG. 2 illustrates the speaker of FIG. 1 with a speaker grille removed.

As illustrated in FIG. 2, a first side 30 of the enclosure 20 includes an upper portion 35 (sometimes referred to as a baffle 35), and a lower portion 40 (similarly referred to as a baffle in some cases). A high-frequency transducer 45 is mounted to the upper portion 35 and a low-frequency transducer 50 is mounted to the lower portion 40. A vent 55 is formed between the upper and lower portions 35 and 40. The upper portion 35 and the lower portion 40 are offset (or spaced) from one another in multiple directions. In some embodiments, the upper portion 35 and the lower portion 40 are constructed of sound blocking materials, such as, for example, wood, a wood composite, or plastic. When constructed of sound blocking materials, the upper portion 35 and the lower portion 40 are baffles. As a result, the lower baffle 35 and the upper baffle 40 function to reduce the amplitude of sound waves inside the enclosure 20 and reduce reverberation. The low-frequency transducer 50 is a woofer, a subwoofer, or the like. The low-frequency transducer is configured to generate a first acoustic signal within a first frequency range. The high-frequency transducer 45 is a horn, compression driver, tweeter, or the like. The high-frequency transducer is configured to generate a second acoustic signal within a second frequency range (e.g., 1.8 kHz to 20 kHz). A set of bumpers 60 are used to position the grille 15.

Figure 3:
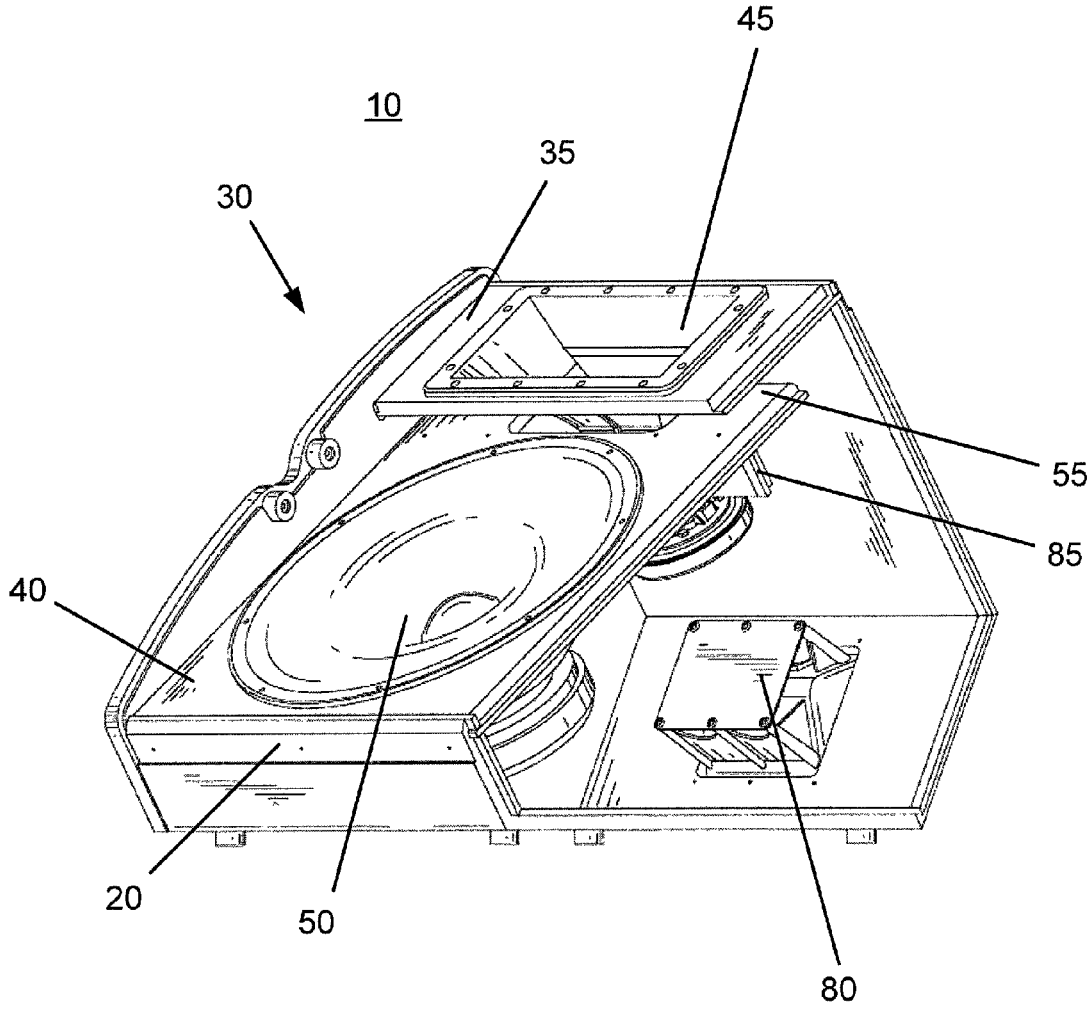
FIG. 3 illustrates the speaker of FIG. 1 with a side panel removed, according to an embodiment of the invention.

In addition to the components described above, the speaker enclosure 20 also includes a crossover circuit 80, as illustrated in FIG. 3. The crossover circuit 80 includes a filter network that is used to separate an electrical signal received from an audio source (such as an amplified signal from a mixing console, audio power amplifier, or other source into two or more signals within predetermined frequency bandwidths before sending them to the transducers (i.e., the high-frequency transducer 45 and the low-frequency transducer 50) of the speaker 10. The crossover circuit 80 divides or separates the electrical signal into frequency bands. For example, the crossover circuit 80 divides the electrical signal into a high-frequency band and a low-frequency band. The high-frequency band of the electrical signal is sent to the high-frequency transducer 45 and the low-frequency band of the electrical signal is sent to the low-frequency transducer 50.

The crossover circuit 80 can be a passive crossover circuit or an active crossover circuit. A passive crossover circuit is constructed from passive components such as resistors, inductors, and capacitors to create one or more passive filters. An active crossover circuit is constructed with active components such as, for example, operational amplifiers or components that require a source of power. An active crossover circuit requires, in many instances, a power amplifier for each output frequency band. For example, if the speaker 10 includes a low-frequency transducer 50 and a high-frequency transducer 45, a power amplifier is included for both the high-frequency band and the low-frequency band outputs of the crossover circuit 80. The power amplifiers are positioned between the crossover circuit 80 and the high and low-frequency transducers 45 and 50. In other embodiments, other types of crossovers circuits are used.

In the embodiment shown, the lower baffle 40 is supported by and extends beyond a beam 85. The beam 85 spans the width of the first side 30 and provides structural support for the enclosure 20. The lower baffle 40 is contoured so that is fits around a portion of the high-frequency transducer 45. In the illustrated embodiment, the lower baffle 40 includes a U-shaped contour or upper edge. In other embodiments, the lower baffle 40 can be contoured in a different fashion. Alternatively, the lower baffle 40 can be dimensioned so that it does not extend beyond the beam 85 and has a straight upper edge. The dimensioning and contouring of the lower baffle affects the size and shape of the vent 55. The vent 55 allows acoustic signals to pass out of the enclosure 20 and enhances a low-frequency response of the speaker 10. Different configurations of the baffle 40 and baffle 35 can be used to change the shape and size of the vent 55.

Figure 4:
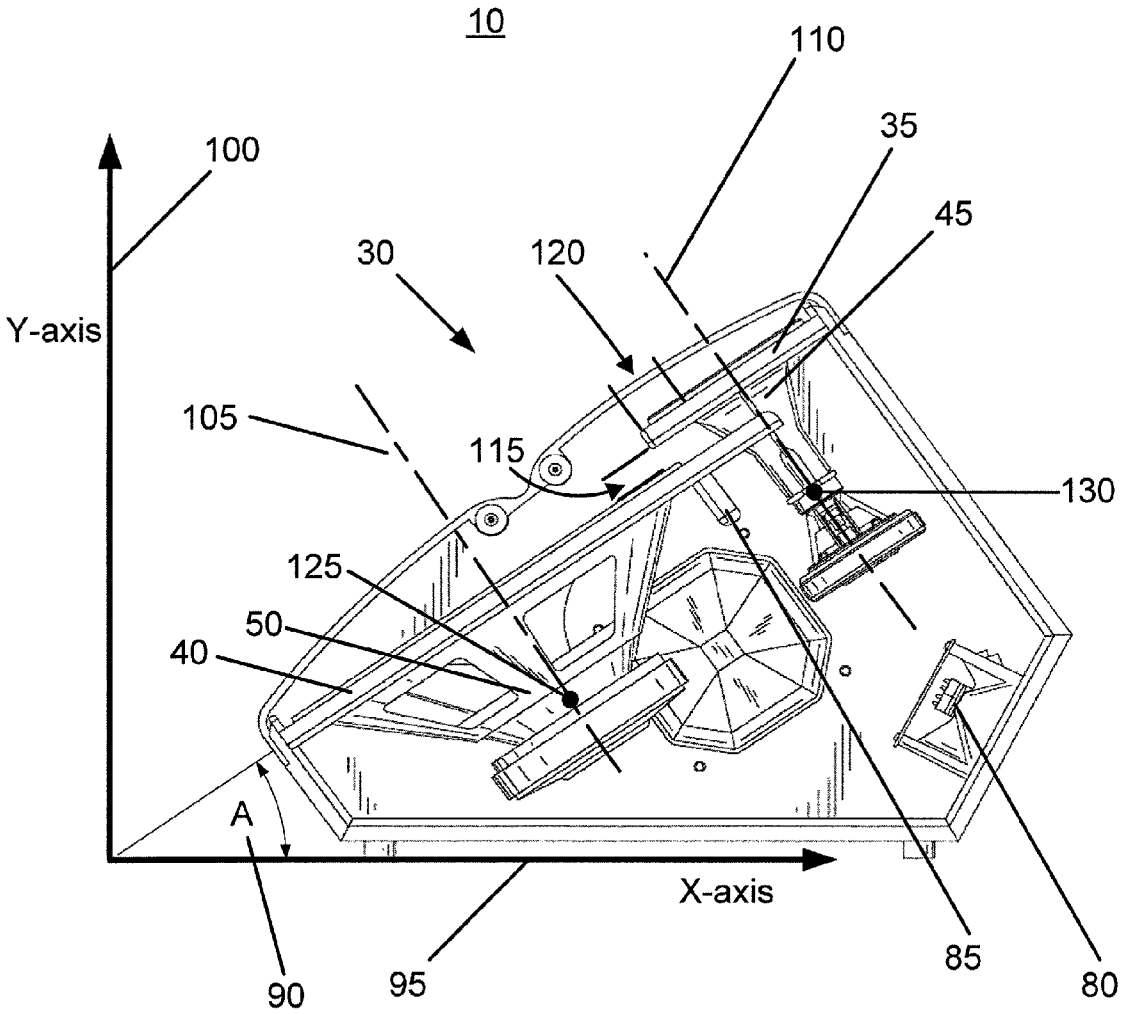
FIG. 4 illustrates a side view of the speaker from FIG. 1, according to an embodiment of the invention.

FIG. 4 illustrates a side view of the speaker 10. The first side 30 of the enclosure 20 is positioned at an angle A 90 with respect to a horizontal axis or plane. In the drawing, an X-axis 95 is shown. The angle can also be measured from a vertical axis or plane (a Y-axis 100 is shown in the drawing). In some embodiments, the lower baffle 40 and the upper baffle 35 are at different angles with respect to the X-axis 95 and the Y-axis 100. The low-frequency transducer 50 and the high-frequency transducer 45 are mounted to the lower baffle 40 and the upper baffle 35, respectively. A low-frequency transducer central axis 105 and a high-frequency transducer central axis 110 are perpendicular to the lower baffle 40 and the upper baffle 35, respectively. Additionally or alternatively, the low-frequency transducer central axis 105 and the high-frequency transducer central axis 110 are parallel to one another. In other embodiments, the low-frequency transducer central axis 105 and the high-frequency transducer central axis 110 are neither perpendicular to the lower baffle 40 and the upper baffle 35, nor parallel to one another.

The lower baffle 40 and the upper baffle 35 are offset both vertically and in depth. For example, the lower baffle 40 and the upper baffle 35 are offset in a direction perpendicular to the angle A 90 by a first distance 115 with the upper baffle 35 being forward of the lower baffle 40. The lower baffle 40 and the upper baffle 35 are also offset in a direction parallel to the angle A 90 by a second distance 120. As a consequence, the lower baffle 40 and the upper baffle 35 are offset both vertically and in depth. The high-frequency transducer central axis 110 and the low-frequency transducer central axis 105 are then closer to one another than if the upper and lower baffles 35 and 40 were coplanar.

A low-frequency transducer acoustic origin 125 and a high-frequency transducer acoustic origin 130 are points at which sound waves appear to originate from the low-frequency transducer 50 and the high-frequency transducer 45, respectively. In some embodiments of the invention, the low-frequency transducer acoustic origin 125 and the high-frequency transducer acoustic origin 130 are not coplanar. In other embodiments, the low-frequency transducer acoustic origin 125 and the high-frequency transducer acoustic origin 130 are coplanar. A low-frequency transducer acoustic origin position and a high-frequency transducer acoustic origin position are adjusted using the upper baffle 35 and the lower baffle 40 to synchronize a low-frequency transducer acoustic signal arrival time and a high-frequency transducer acoustic signal arrival time in a listening area, for example, a location on a stage, a location in a room, or a location in a concert hall. A time-domain measurement of acoustic signal arrival times in a far field or the listening area is used to verify that the low-frequency transducer acoustic signal arrival time and the high-frequency transducer acoustic signal arrival time are synchronized.

The first and second offsets 115 and 120 also define the vent 55 between the lower baffle 40 and the upper baffle 35. As described above, the vent 55 extends across the width of the first side 30. The vent 55, first offset 115, and second offset 120 can be designed to synchronize acoustic signal arrival times of different combinations of transducers and to tune a Helmholtz frequency of the enclosure. In the described embodiment, the vent 55, first offset 115, and second offset 120 are designed for a woofer (low-frequency transducer) 50 and a horn (high-frequency transducer) 45. In other embodiments, different transducers are used.

Figure 5:
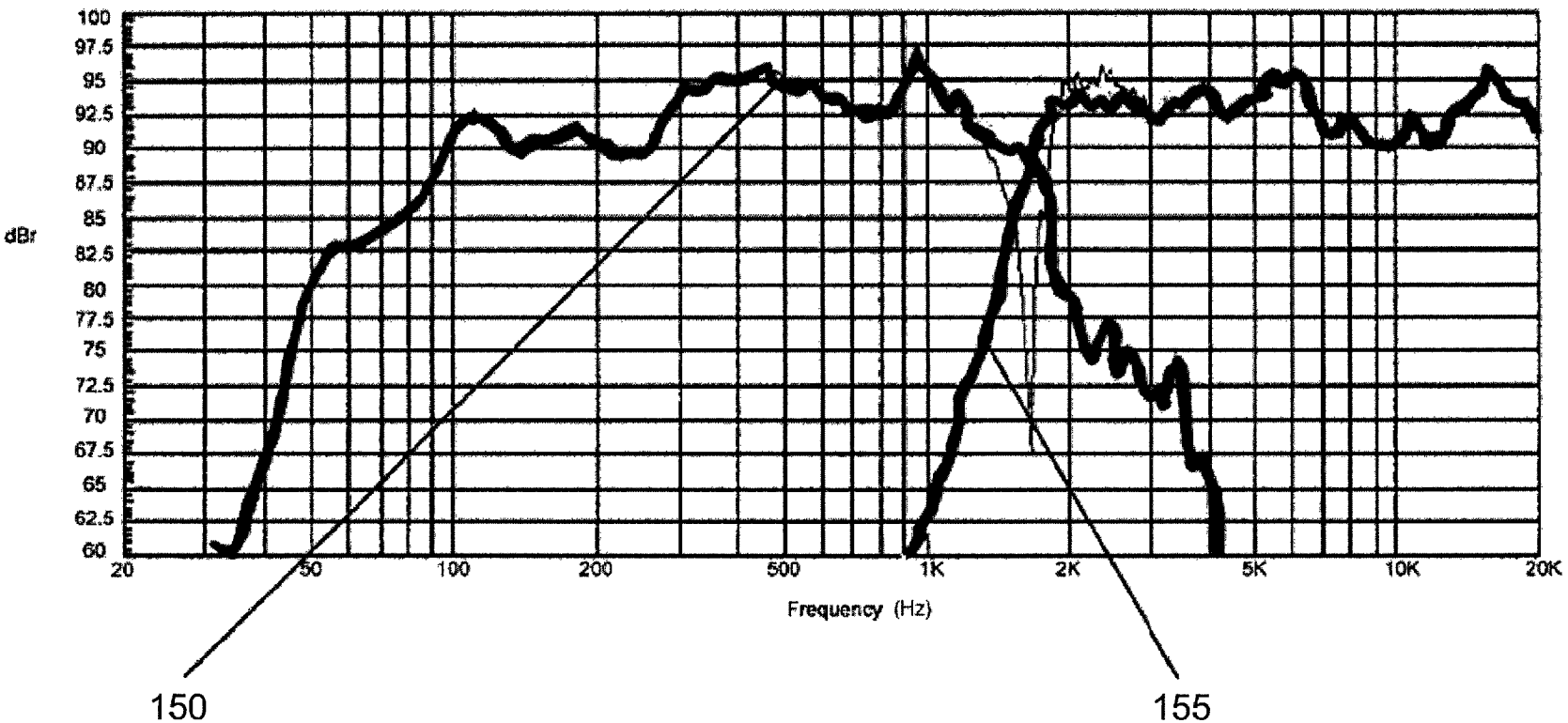
FIG. 5 illustrates a low-frequency response plot and a high-frequency response plot of the speaker of FIG. 1.
Figure 6:
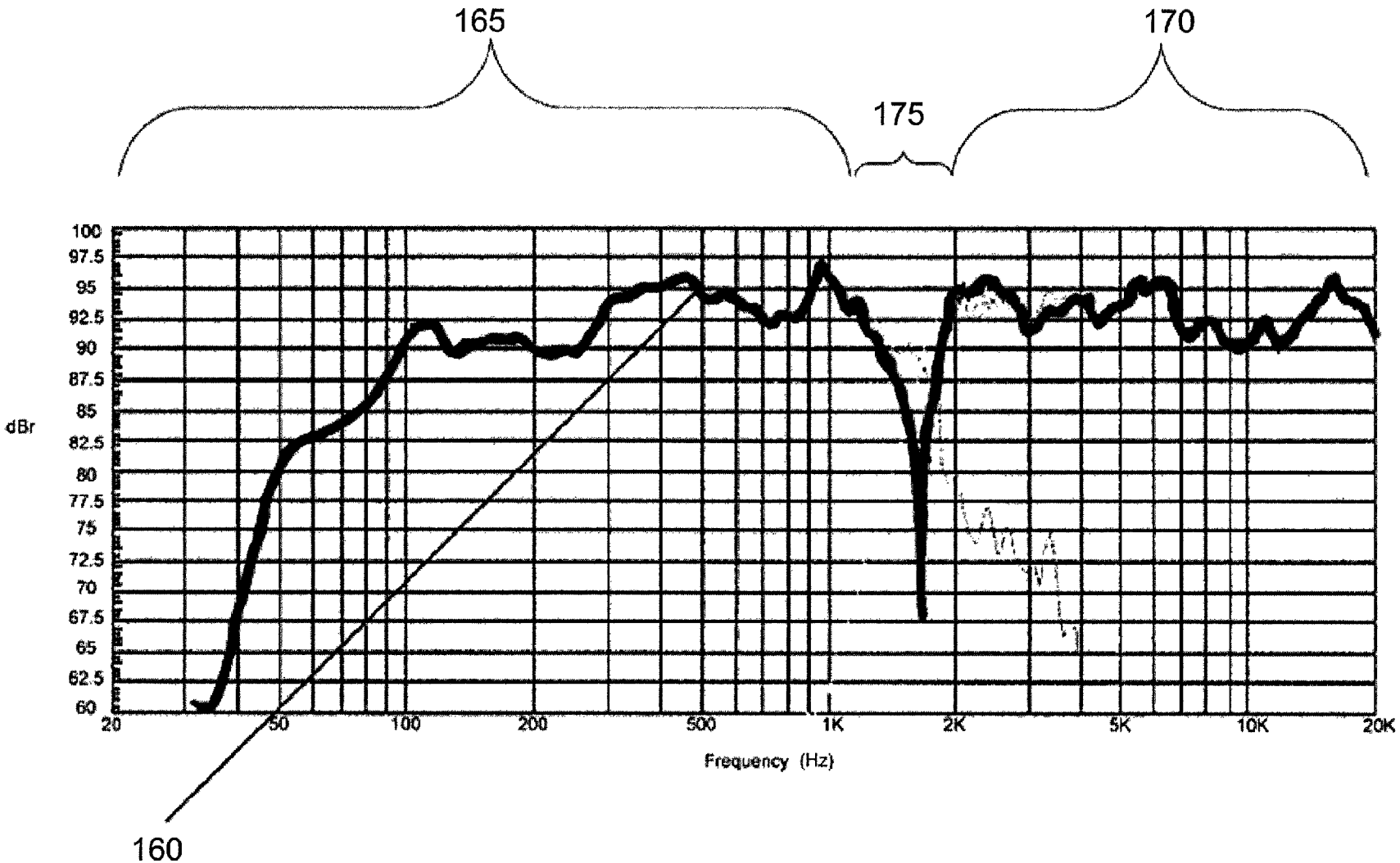
FIG. 6 illustrates an out-of-phase summation of the low-frequency response plot and the high-frequency response plot of FIG. 5.

FIG. 5 illustrates a low-frequency response plot 150 and a high-frequency response plot 155 of an embodiment of the speaker 10. FIG. 6 illustrates an out-of-phase summation frequency response plot 160 of the low-frequency response plot 150 and the high-frequency response plot 155 of the speaker 10 from FIG. 5. The frequency response is plotted on a logarithmic scale and illustrates the frequency response of the speaker 10 through a typical human hearing range of approximately 20 Hz to approximately 20 kHz. The frequency response plot 160 includes a low-frequency response band 165, a high-frequency response band 170, and a crossover frequency response band 175. The frequency response plot 160 illustrates a significant notch at a crossover frequency of approximately 1.8 kHz. The notch in the crossover frequency response band 175 of the out-of-phase summation frequency response plot 160 indicates a precise arrival time synchronization of the low-frequency transducer acoustic signal and the high-frequency transducer acoustic signal at the low-frequency transducer acoustic origin and the high-frequency transducer acoustic origin.

Figure 7:
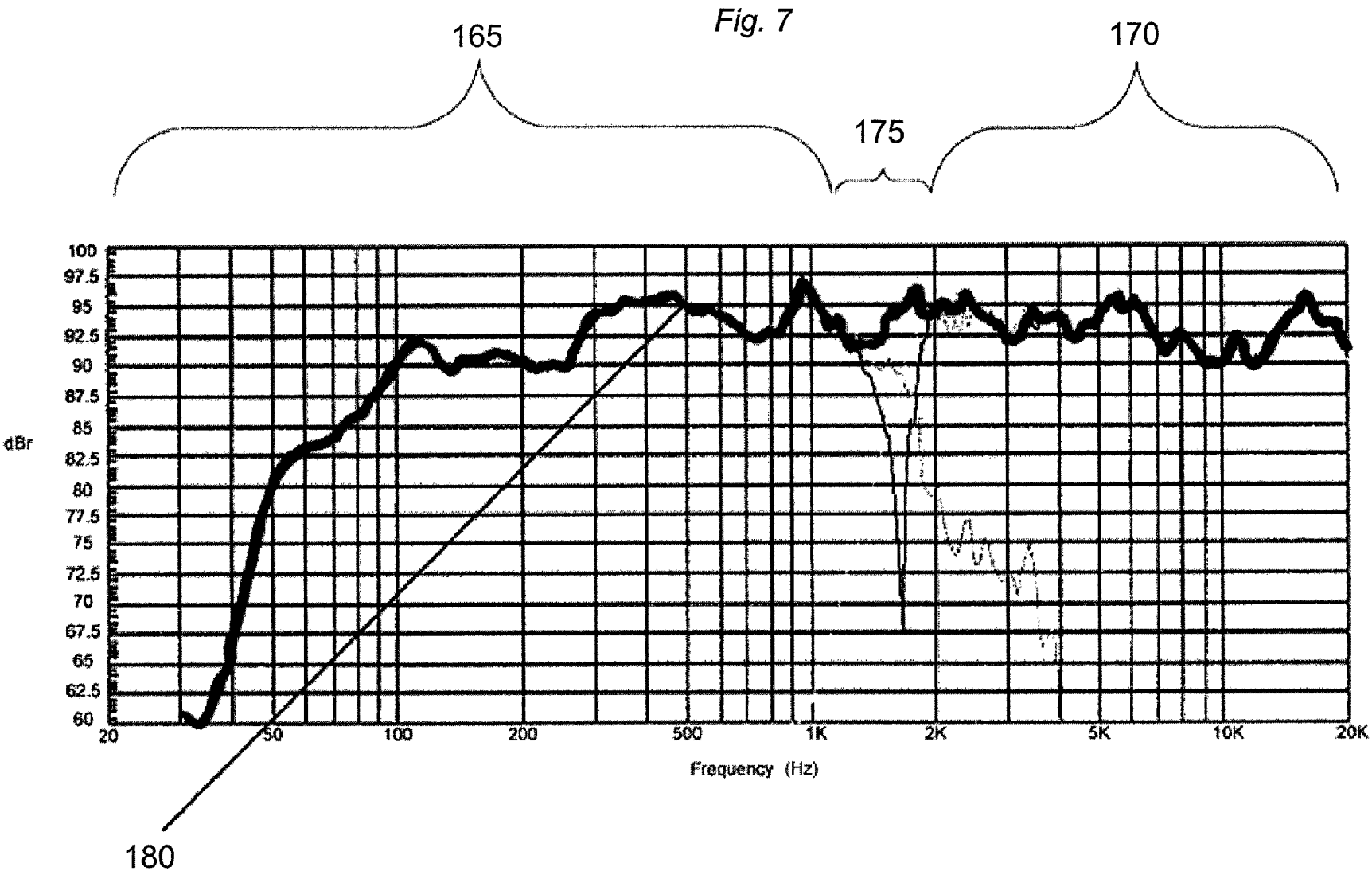
FIG. 7 illustrates an in-phase summation of the low-frequency response plot and the the high-frequency response plot of FIG. 5.

FIG. 7 illustrates an in-phase summation of the low-frequency response plot 150 and the high-frequency response plot 155 of the speaker 10 from FIG. 5. When summed, the low-frequency response plot 150 and the high-frequency response plot 155 of the speaker 10 result in an in-phase frequency response plot 180. The in-phase frequency response plot 180 illustrates a flat frequency response (within ±3 decibels) through the crossover frequency response band 175. The flat frequency response indicates a nearly ideal summation of the low-frequency response plot 150 and the high-frequency response plot 155. As a result, the speaker 10 produces, in many instances, higher fidelity sound than a speaker that does not include the above-described features. As noted, the upper baffle 35 and the lower baffle 40 are displaced by a first offset in a first direction and a second offset in a second direction to adjust the high and low-frequency transducer acoustic origin positions. The upper and lower baffles are configured such that the low-frequency transducer acoustic signal arrival time and the high-frequency transducer acoustic signal arrival time are synchronized. The vent 55 extends across the width of the first side 30 of the speaker enclosure 20 to enhance the low-frequency response of the speaker 10.

Thus, the invention provides, among other things, a speaker with offset upper and lower baffles for synchronizing the arrival times of acoustic signals from a low-frequency transducer and a high-frequency transducer. Various features and advantages of the invention are set forth in the following claims.

What is claimed is:

1. A speaker comprising:

an enclosure including a first side positioned at an angle with respect to a horizontal axis, the first side including an upper portion and a lower portion, the upper portion and the lower portion offset from one another by a first offset in a first direction and a second offset in a second direction, the first offset in the first direction and the second offset in a second direction defining a vent extending across a width of the first side, the vent positioned above a low-frequency transducer and below a high-frequency transducer;

the low-frequency transducer mounted to the lower portion, the low-frequency transducer configured to generate a first acoustic signal within a first frequency range;

the high-frequency transducer mounted to the upper portion, the high-frequency transducer configured to generate a second signal within a second frequency range;

the low-frequency transducer and the high-frequency transducer being displaced by the first offset in the first direction and the second offset in the second direction to adjust a low-frequency transducer acoustic origin position and a high-frequency transducer acoustic origin position; and the upper portion and the lower portion configured such that a first acoustic signal arrival time and a second acoustic signal arrival time are synchronized in a listening area.

2. The speaker of claim 1, further comprising a low-frequency transducer axis and a high-frequency transducer axis, wherein the low-frequency transducer axis and the high-frequency transducer axis are parallel.

3. The speaker of claim 1, further comprising a low-frequency transducer axis and a high-frequency transducer axis, wherein the low-frequency transducer axis and the high-frequency transducer axis are perpendicular to the lower portion and the upper portion, respectively.

4. The speaker of claim 1, wherein the lower portion is a lower baffle and the upper portion is an upper baffle.

5. The speaker of claim 1, further comprising a filter network.

6. The speaker of claim 5, wherein the filter network is a passive crossover circuit.

7. The speaker of claim 5, wherein the filter network is an active crossover circuit.

8. The speaker of claim 1, wherein the first offset in the first direction is a vertical offset and the second offset in the second direction is an offset in depth.

9. A speaker comprising:

an enclosure including a lower baffle and an upper baffle, the lower baffle and the upper baffle offset from one another by a first offset in a first direction and a second offset in a second direction, the first offset in the first direction and the second offset in a second direction defining a vent extending across a width of the enclosure, the vent positioned above a woofer and below a horn;

the woofer mounted to the lower baffle, the woofer configured to generate a first acoustic signal within a first frequency range;

the horn mounted to the upper baffle, the horn configured to generate a second acoustic signal within a second frequency range; and the woofer and the horn being displaced by the first offset in the first direction and the second offset in the second direction to adjust a woofer acoustic origin position and a horn acoustic origin position, the woofer acoustic origin position and the horn acoustic origin position adjusted such that a first acoustic signal arrival time and a second acoustic signal arrival time are synchronized in a listening area.

10. The speaker of claim 9, wherein the first acoustic signal and the second acoustic signal arrive concurrently at the woofer acoustic origin and the horn acoustic origin, respectively, due to the first offset in the first direction and the second offset in the second direction.

11. The speaker of claim 9, further comprising a woofer axis and a horn axis, wherein the woofer axis and the horn axis are parallel.

12. The speaker of claim 9, further comprising a woofer axis and a horn axis, wherein the woofer axis and the horn axis are perpendicular to the lower baffle and the upper baffle, respectively.

13. The speaker of claim 9, further comprising a filter network.

14. The speaker of claim 13, wherein the filter network is a passive crossover circuit.

15. The speaker of claim 13, wherein the filter network is an active crossover circuit.

16. The speaker of claim 9, wherein the first offset in the first direction is a vertical offset and the second offset in the second direction is an offset in depth.

17. A method of synchronizing at least two acoustic signals at respective acoustic origins, the method comprising:

positioning a lower baffle at a first angle with respect to a horizontal axis;

positioning an upper baffle at a second angle with respect to the horizontal axis;

mounting a woofer to the lower baffle;

mounting a horn to the upper baffle;

adjusting a woofer acoustic origin position and a horn acoustic origin position by displacing the lower baffle and the upper baffle by a first offset in a first direction and a second offset in a second direction;

positioning the upper baffle and the lower baffle such that there is a vent between the two;

generating, at the woofer, a first acoustic signal within a first frequency range;

generating, at the horn, a second acoustic signal within a second frequency range; and synchronizing a first acoustic signal arrival time and a second acoustic signal arrival time in a listening area.

18. The method of claim 17, further comprising positioning a woofer axis parallel to a horn axis.

19. The method of claim 17, further comprising positioning a woofer axis perpendicular to the lower baffle; and positioning a horn axis perpendicular to the upper baffle.

20. The method of claim 17, wherein displacing the lower baffle and the upper baffle by the first offset in the first direction and the second offset in the second direction includes offsetting the lower baffle and the upper baffle vertically and in depth.

21. The method of claim 17, wherein positioning the lower baffle at the first angle and positioning the upper baffle at the second angle includes positioning the lower baffle and the upper baffle at the same angle.

* * * * *